US005437072A

United States Patent [19]

Dinis et al.

[11] Patent Number: 5,437,072

[45] Date of Patent: Aug. 1, 1995

[54] RAPID TRANSIT VIADUCT WITH POST-TENSIONING CABLE SYSTEM

[75] Inventors: Antonio Dinis, La Jolla; Gerard Sauvageot, Poway, both of Calif.

[73] Assignee: J. Muller International, San Diego, Calif.

[21] Appl. No.: 100,687

[22] Filed: Aug. 2, 1993

Related U.S. Application Data

[63] Continuation-in-part of Ser. No. 839,858, Feb. 21, 1992, Pat. No. 5,231,931, which is a continuation-in-part of Ser. No. 824,502, Jan. 23, 1992, abandoned.

[51] Int. Cl.[6] ..... E01B 26/00; E01D 21/10

[52] U.S. Cl. ..... 14/73; 14/6; 14/14; 14/77.1; 52/223.11; 104/124

[58] Field of Search ..... 14/77.1, 78, 73, 73.1, 14/74.5, 18, 22, 6, 14; 104/124, 125; 52/223.8, 223.9, 223.11, 223.14

[56] References Cited

U.S. PATENT DOCUMENTS

| | | | |
|---|---|---|---|
| 3,398,498 | 8/1968 | Krauss | 52/223.8 X |
| 4,589,157 | 5/1986 | Richard | 14/73 |
| 4,625,354 | 12/1986 | Richard | 14/73 |
| 4,651,375 | 3/1987 | Macchi | 14/77.1 X |
| 4,799,279 | 1/1989 | Muller | 14/77.1 |
| 5,052,309 | 10/1991 | Haselwander et al. | 104/124 |

*Primary Examiner*—Ramon S. Britts
*Assistant Examiner*—James A. Lisehora
*Attorney, Agent, or Firm*—Baker, Maxham, Jester & Meador

[57] ABSTRACT

Advantageously, the present invention also facilitates a unique method for post-tensioning segmental viaduct structures, for rapid transit use or otherwise, wherein post-tensioning cables do not follow load diagrams but instead follow uniform paths through each viaduct segment. In this way, each viaduct segment need not be specially fabricated to accommodate uniquely positioned cables.

11 Claims, 9 Drawing Sheets

PHASE 1

PHASE 2

RAPID TRANSIT VIADUCT WITH POST-TENSIONING CABLE SYSTEM

RELATED APPLICATIONS

The present application is a continuation-in-part of application Ser. No. 07/839,858, filed Feb. 21, 1992, now U.S. Pat. No. 5,231,931, which is a continuation-in-part of application Ser. No. 07/824,502, filed Jan. 23, 1992, now abandoned.

BACKGROUND OF THE INVENTION

The present invention relates to viaduct systems for rail and rapid transit lines.

The current technology used for rail and rapid transit viaducts is based on the experience developed for road viaducts. FIG. 1 illustrates a prior art viaduct structure wherein sets of rails are supported on a concrete platform or deck. The deck is mounted on top of a plurality of longitudinal support beams which are in turn mounted on top of transverse pier caps cast from concrete. The longitudinal support beams are steel girders. In another prior art construction, illustrated in FIG. 2, the rails are supported on top of a longitudinal box section mounted on piers. The box section is cast from concrete.

The prior art viaduct structures are disadvantageous from the standpoint of cost, aesthetics, safety and noise. In most rapid transit designs, a minimum clearance height is required between the ground and the rail support structure, with a 15 foot minimum being typical. In prior art structures, the actual height of the rapid transit vehicle is substantially above the minimum clearance height. In the construction of FIG. 1, the rail height is determined by the combined depth of the pier cap, the longitudinal support girders and the concrete deck. In the construction of FIG. 2, the rails are placed on top of the full depth of the load bearing box section. In either construction, it is impractical to minimize track height by reducing the depth of the longitudinal load bearing structures. Indeed, a design constraint of railway viaduct systems is that vertical load deflections be kept to a minimum to reduce the possibility of derailment. The longitudinal load bearing structures should thus have good bending stiffness, which is achieved most efficiently with tall bending sections having large moments of inertia.

FIGS. 1 and 2 illustrate the relative disadvantages of the prior art designs in terms of added rail height, as represented by the difference between the track level and the street clearance. As a result of this excessive rail height, increased costs are incurred for additional pier foundation materials in order to withstand transverse loads induced by trains on the substructure. Such loading creates bending moments at the pier foundations in direct proportion to track height. Additional costs are also incurred as a result of having to build higher station platforms in order to reach the track level.

From an aesthetics standpoint, the increased height of the prior art viaduct structures means that the entire structure is more visible from ground locations. From a safety standpoint, the prior art designs do nothing to reduce the possibility of collisions should a derailment occur. As to noise, there are often no structures provided to minimize vehicle sound levels at ground level.

A further disadvantage of prior art viaduct structures made from precast segmental sections and built span-by-span, whether for rapid transit or other purposes, stems from the manner in which such structures are post-tensioned. Conventional technology in precast segmental viaduct structures built span-by-span is to assemble one span over a steel truss, and to place and stress a plurality of post-tensioning cables that follow the parabolic diagram of load moments. The post tensioning cables are generally anchored at both ends of each span. As shown in FIG. 3, provision must be made in the viaduct segments for routing the cables along the moment curve, whatever the path of the moment curve. Each segment must therefore be uniquely fabricated to support the cables in their proper position.

SUMMARY OF THE INVENTION

It is therefore a primary object of the present invention to provide an improved rapid transit viaduct system which provides advantages of reduced cost, improved aesthetics, enhanced safety and limited noise pollution. To that end, a rapid transit viaduct structure is defined cross-sectionally by a central load bearing span or body member and a pair of lateral platform structures mounted to opposite lower side portions of the central load bearing body. The lateral platform structures carry one or more rapid transit vehicles on either side of the central body member. The viaduct structure is supported between vertically extending piers positioned below the central body member.

Advantageously, the present invention also facilitates a unique method for post-tensioning segmental viaduct structures, for rapid transit use or otherwise, wherein post-tensioning cables do not follow load diagrams but instead follow uniform paths through each viaduct segment. In this way, each viaduct segment need not be specially fabricated to accommodate uniquely positioned cables.

BRIEF DESCRIPTION OF THE DRAWINGS

The objects, advantages and features of the invention are disclosed in more detail below in conjunction with the accompanying drawings in which.

DETAILED DESCRIPTION OF THE PREFERRED EMBODIMENTS

Figure 4:
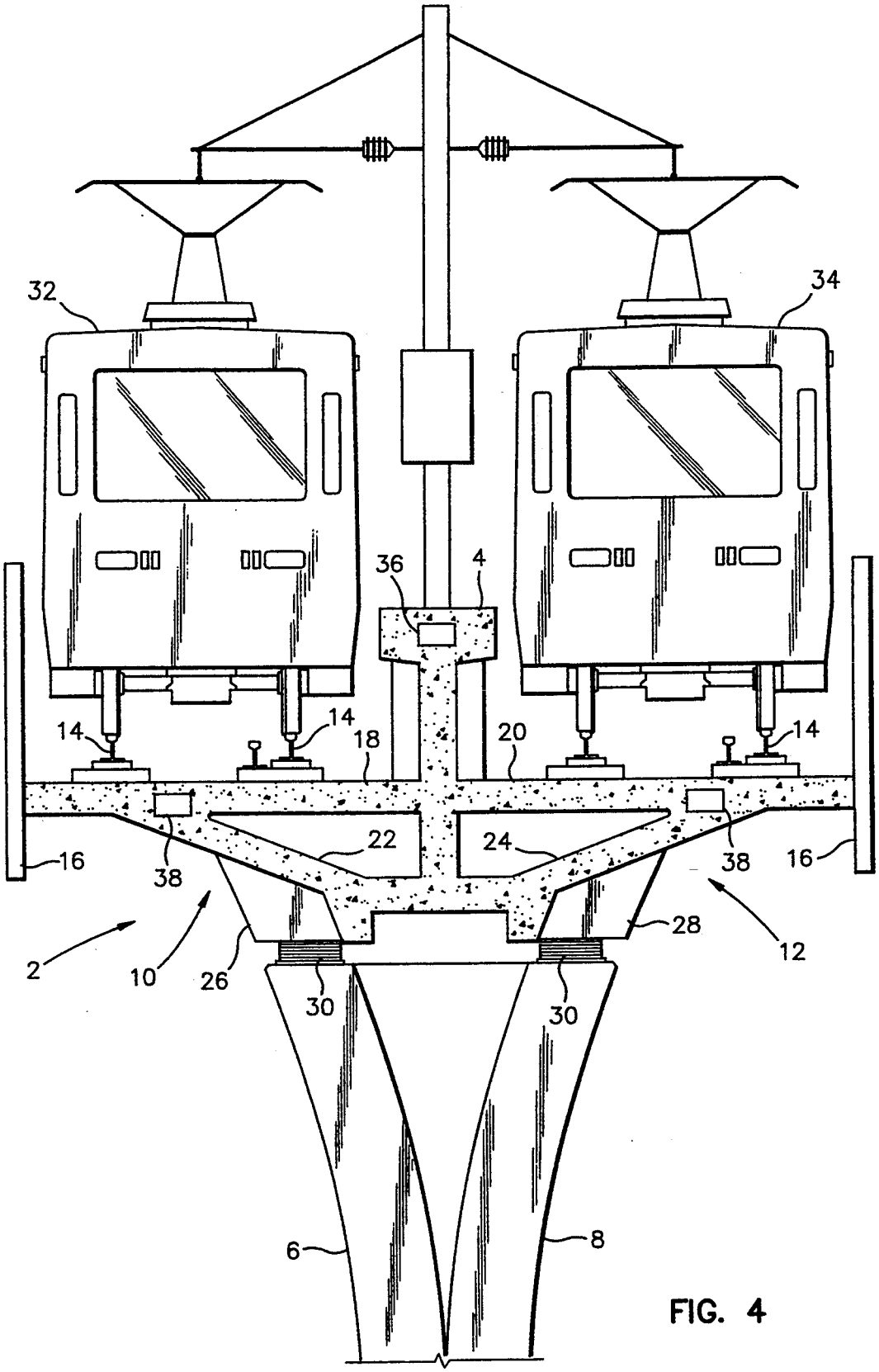
FIG. 4 is a partial diagrammatic view showing a cross-section of a rapid transit viaduct system constructed in accordance with the present invention.

Referring now to FIG. 4, a rapid transit viaduct section 2 includes a central load bearing span or body member 4 supported by a pair of upright pier members 6 and 8. Extending laterally from opposite lower side portions of the central body 4 are a pair of lateral platform structures 10 and 12. Each of the platform structures 10 and 12 has a pair of rails 14 mounted thereon for carrying a rapid transit vehicle. In addition, each of the platform structures may be provided with an upright side wall section 16 as required by safety, noise pollution, and other considerations. One or more sets of rails 14 are carried by each of the lateral platform structures depending on the requirements of the rapid transit system.

The platform structures 10 and 12 each include respective upper platform decks 18 and 20, and respective lower support struts 22 and 24. The lower support struts 22 and 24 are mounted as close to the bottom of the central load bearing body 4 as practicable. Deck members 18 and 20 are mounted to the central body 4 at an intermediate portion thereof above the support struts 22 and 24. The support struts angle upwardly from their point of attachment with the load bearing body 4 until they intersect the deck members. As such, the deck members 18 and 20 and support struts 22 and 24 form a box section providing resistance to torsional loading caused by track curvature and differential train loading. This box section may be considered a closed base. The load bearing body 4 bisects the closed base and extends vertically upwardly therefrom to provide span-wise bending resistance. Preferably, the entire viaduct section 2 is cast as a single reinforced concrete cross-section.

The platform sections 10 and 12 each include lower pier mounts 26 and 28. These are mounted respectively to the bottom of the supports struts 22 and 24. The pier mounts 26 and 28 are in turn supported, respectively, on the piers 6 and 8 using a plurality of Neoprene pads 30, which provide a cushioned support for the structure.

The viaduct section 2 forms part of a viaduct system supporting rails 14 for carrying rapid transit vehicles 32 and 34. These vehicles are conventional in nature and may be powered electrically as shown in FIG. 4. As discussed in more detail below, the viaduct section 2 may be cast in place as an elongated span-wise section or may be formed as a precast modular segment. In the latter instance, the viaduct section 2 is combined with other viaduct sections to form a precast segmental structure. To facilitate that construction, the load bearing body 4 may be formed with an interlock member 36, while the lateral platform structures 10 and 12 may each be formed with interlock members 38.

Figure 5:
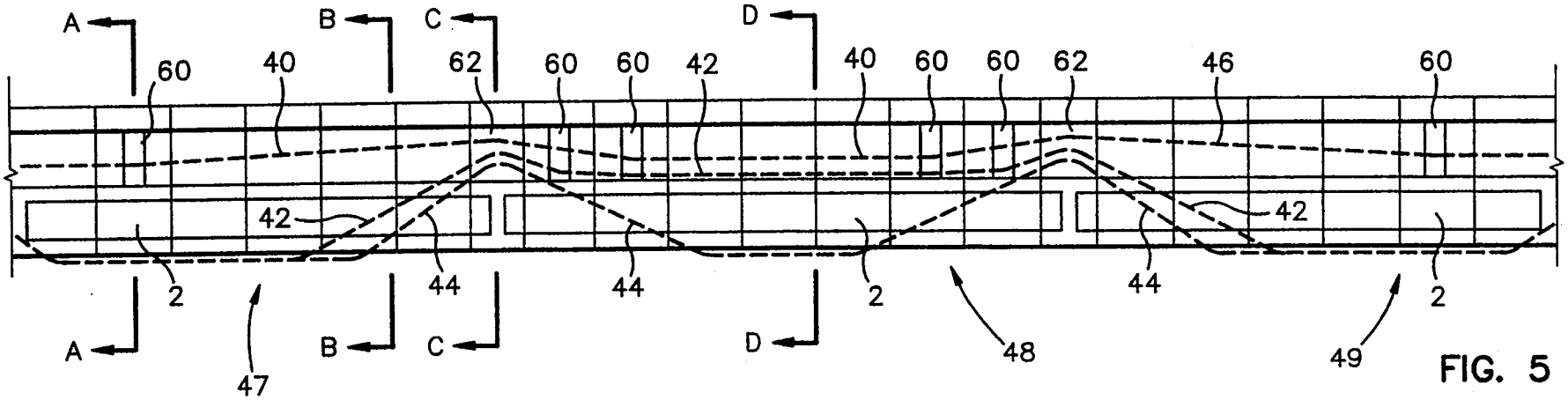
FIG. 5 is an elevational side view of the viaduct system of FIG. 4.
Figure 6:
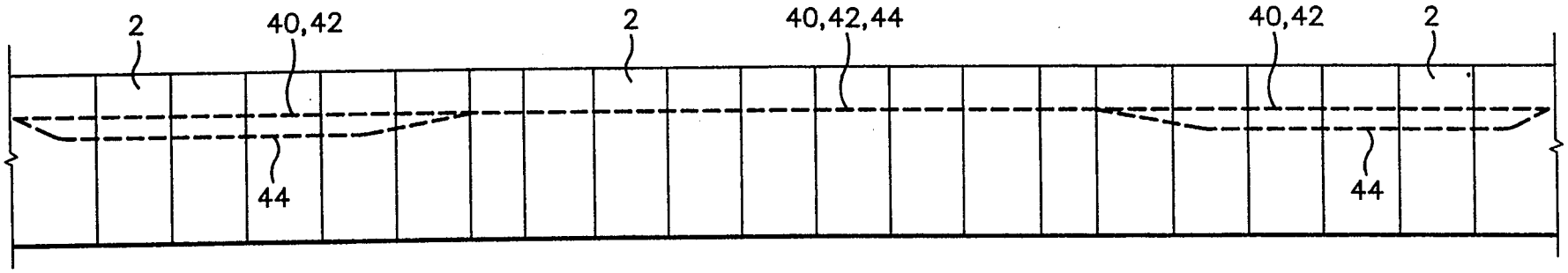
FIG. 6 is a plan view of the viaduct system of FIG. 5.
Figure 7:
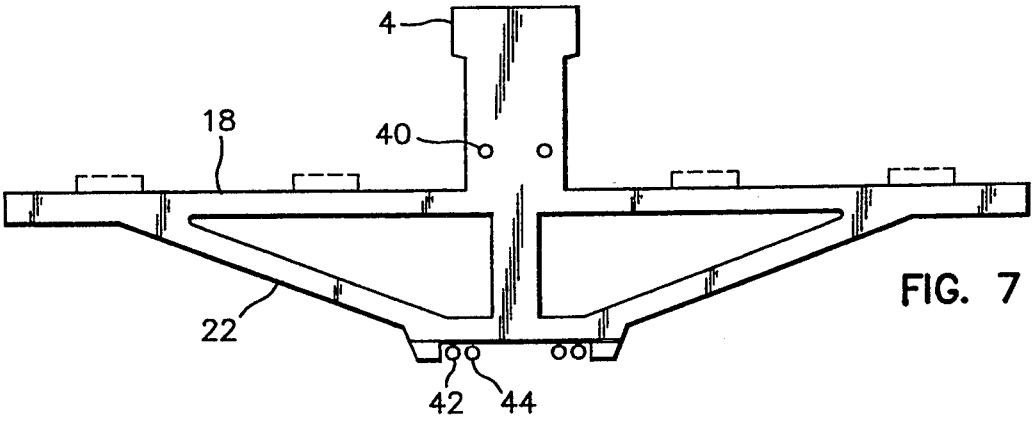
FIG. 7 is a diagrammatic cross-sectional view taken along lines A—A in FIG. 5.
Figure 8:
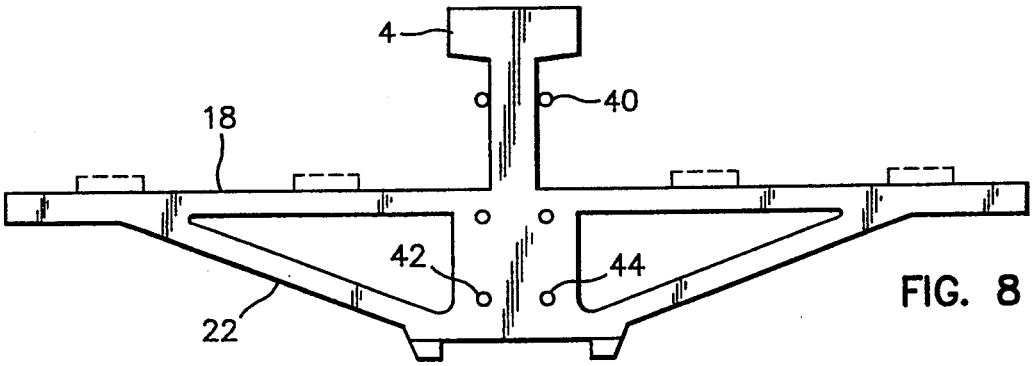
FIG. 8 is a diagrammatic cross-sectional view taken along lines B—B in FIG. 5.
Figure 9:
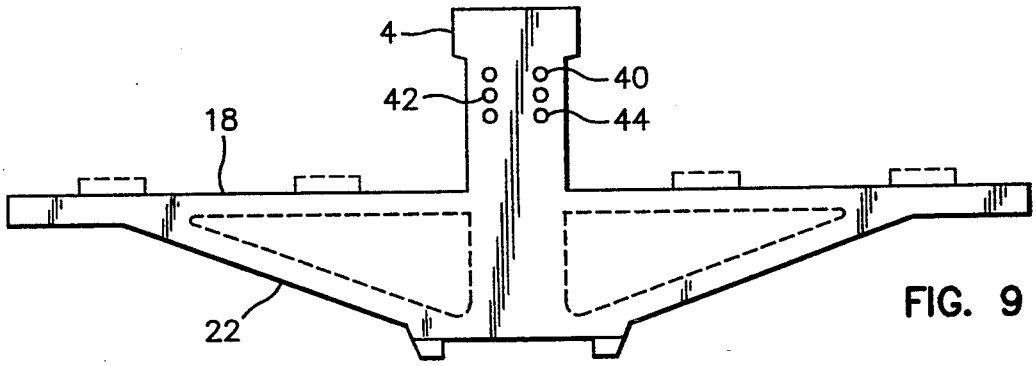
FIG. 9 is a diagrammatic cross-sectional view taken along lines C—C in FIG. 5.
Figure 10:
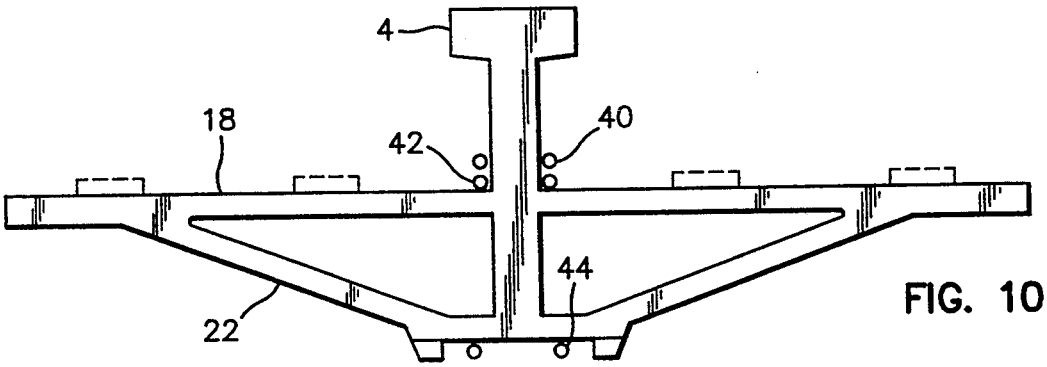
FIG. 10 is a diagrammatic cross-sectional view taken along lines D—D in FIG. 5.

Referring now to FIGS. 5 and 6, a viaduct system is formed from a plurality of precast viaduct sections 2 formed as modular segments and combined as a precast segmental structure extending between sequentially positioned piers (not shown). The viaduct sections 2 are placed in longitudinally abutting relationship. To facilitate that construction, the viaduct sections are preferably match cast so that the abutting end portions thereof fit one another in an intimate interlocking relationship. Each successive section is therefore cast against a previously cast adjacent section to assure interface continuity.

The connection between adjacent modular sections is further secured by way of the interlock members 36 and 38. On one end of each viaduct section 2 the interlock members 36 and 38 are formed as external keys. On the opposite end of each viaduct section 2 the interlock members are formed as an internal slot or notch, corresponding to the key members of the adjacent viaduct section. Match casting assures that corresponding keys and slots, as well as the remaining interface surfaces, properly interfit one another.

In the viaduct system of FIGS. 5 and 6, the viaduct sections 2 are bound together with one or more post tensioning cables or tendons 40, 42 and 44. The number of cables used will depend on a number of factors such as cable thickness, span length and loading requirements. The tensioning cables are each routed along a predetermined serpentine path which varies in vertical and lateral position along the span of the segmental viaduct structure.

In FIGS. 5 and 6, the viaduct system is shown as having three segmental spans 47, 48 and 49, the ends of which are supported by pier structures (not shown) of the type illustrated in FIG. 4. FIGS. 7, 8, 9 and 10 illustrate, diagrammatically, the manner in which the post tensioning cables 40, 42 and 44 vary in vertical and lateral position as they pass through these spans. The figures also reveal that the post tensioning cables are sometimes positioned within the viaduct sections themselves, and at other times are positioned externally thereof.

Figure 11:
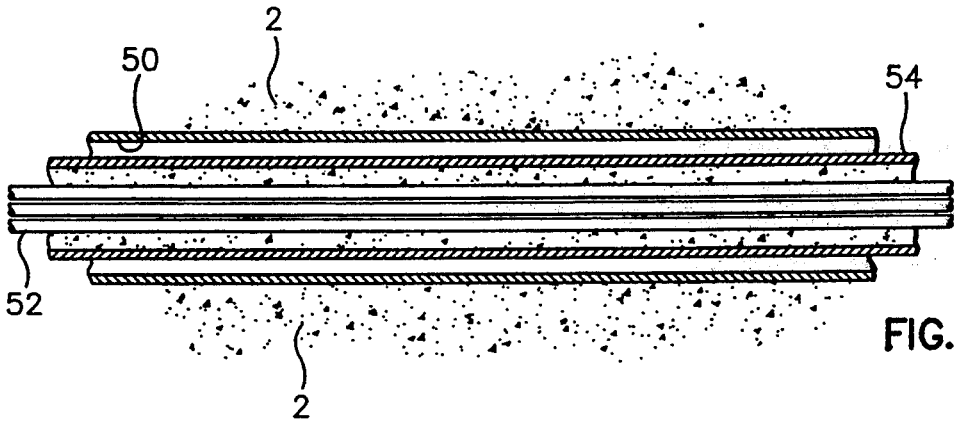
FIG. 11 is a projected diagrammatic view showing the routing of a post tensioning cable in the viaduct system of FIG. 5.

Referring now to FIG. 11, it will be seen that the viaduct sections 2 are formed with appropriate guide ducts 50 at locations where the post tensioning cables pass through the viaduct structure. The post tensioning cables, identified collectively by reference numeral 52 in FIG. 11, are routed through the guide ducts 50. To facilitate that routing, a continuous flexible conduit 54 is initially inserted through the guide ducts, and the post tensioning cables 52 are thereafter placed in the conduit. The conduit 54 may be advantageously formed from polyethylene pipe but could also be formed from flexible metallic materials. The post tensioning cables 52 are tensioned using conventional post tensioning apparatus and the interior of the conduit 54 is cement grouted along the entire length thereof for corrosion protection.

As indicated, the routing path of the post tensioning cables 40, 42 and 44 may at times lie externally of the viaduct sections, above and below the lateral platform structures 10 and 12. Below the platform structures, the bottom of the viaduct section itself supports the post tensioning cables. Above the platform structures, post tensioning cable routing is facilitated using deviator structures 60, the locations of which are illustrated in FIG. 5. The viaduct sections at the ends of each viaduct span are also provided with cable end mounts 62 which also function to route the tensioning cables.

Figure 12:
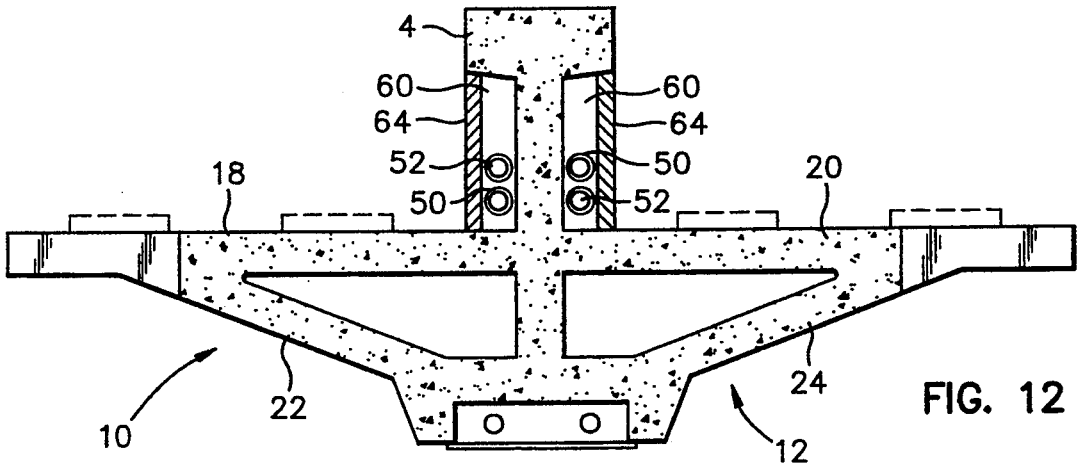
FIG. 12 is a view through a cross-section of the viaduct system of FIG. 5, showing the construction of a post tensioning cable deviator and cover plate.

FIG. 12 illustrates a cross-section taken through one of the deviators 60. The deviators 60 are preferably formed of concrete and cast directly into the viaduct section 2. Each deviator 60 is formed with one or more guide ducts 50 for receiving one of the conduits 54. Optionally, a pair of side cover plates 64, made from steel or the like, may be mounted along the entire viaduct span, exteriorly of the deviators 60. The cover plates provide protection against damage to the exposed portions of the post tensioning cables positioned above the deck members 18 and 20.

Figure 13:
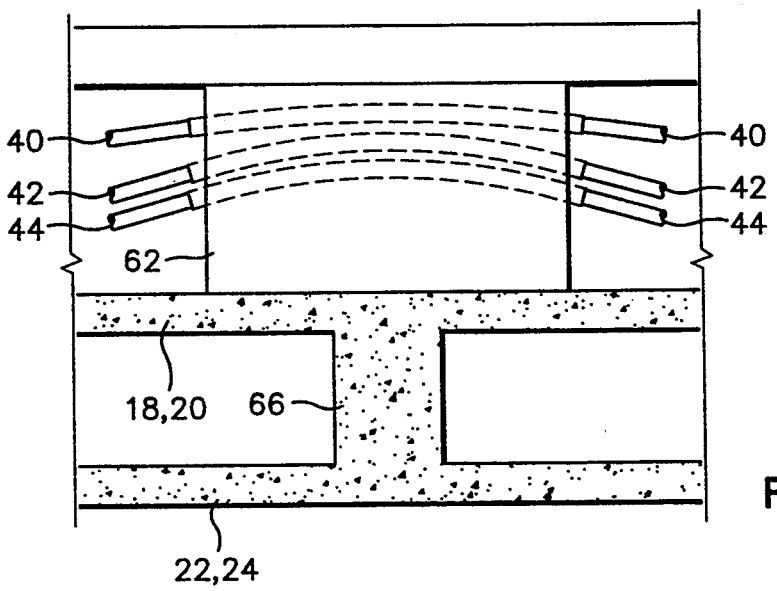
FIG. 13 is a view through a cross-section of the viaduct system section of FIG. 12, showing the construction of post tensioning cable supports and lower support brace.

Referring now to FIG. 13, the cable end mounts 62 are illustrated. Like the deviators 60, the end mounts 62 are preferably made from concrete and cast as part of the viaduct section. The end mounts 62 are also formed with one or more guide ducts 50 for receiving one of the conduits 54. In addition, because the end mounts 62 must support substantial downward loads imparted by the tensioning cables, there is provided between the deck section 18 and 22 and lower support struts 22 and 24, a lower support brace 66.

Figure 14:
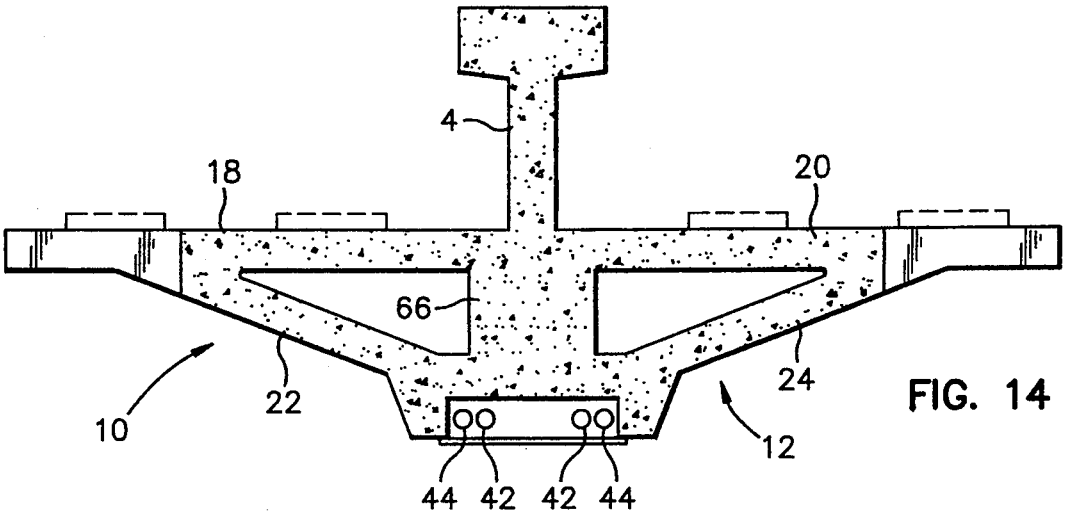
FIG. 14 is a view through a cross-section of the viaduct system of FIG. 5, showing the construction of a lower post tensioning cable support section.

Referring now to FIG. 14, and as previously stated, some of the post tensioning cables are routed through the lateral platform structures 10 and 12 to the bottom of the viaduct section. To support the post tensioning cables during their transition through the platform sections 10 and 12, the central body member 4 may be provided with lower cable routing blocks 66.

Figure 15:
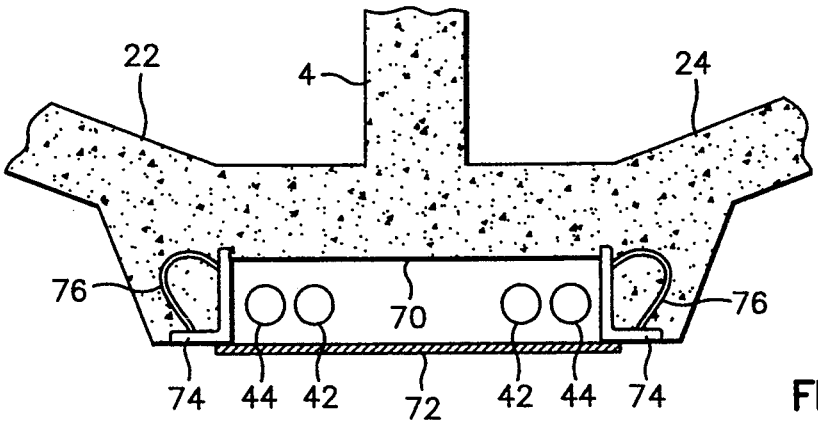
FIG. 15 is an enlargement of the section of FIG. 14, showing a system for routing tensioning cables along the bottom the viaduct system of FIG. 5.
Figure 16:
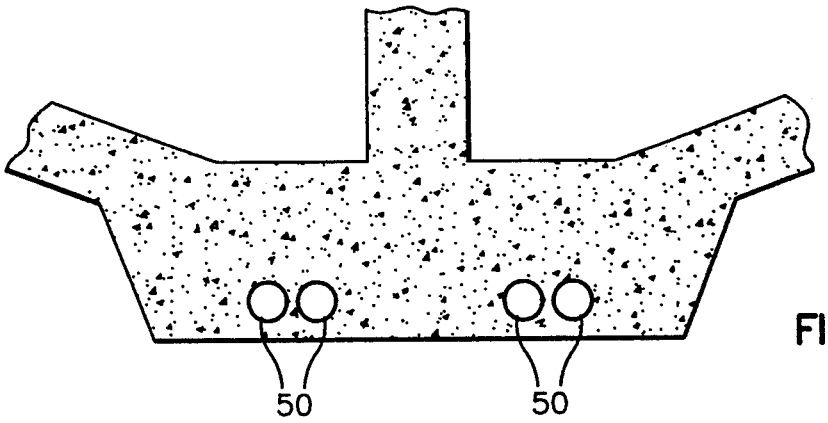
FIG. 16 is a detailed cross-sectional view showing an alternative system for routing tensioning cables along the bottom of the viaduct system of FIG. 5.

Referring now to FIGS. 15 and 16, the post tensioning cables extending along the bottom of the viaduct structure may be located either externally of the structure, as shown in FIG. 15, or internally therein, as shown in FIG. 16. In the external construction of FIG. 15, the viaduct section is provided with a lower channel 70 centered below the central body member 4. The channel 70 serves as a guide for the post tensioning cables. To protect the post tensioning cables against damage from vehicle collisions, fire and environmental damage, the channel 70 is covered with a longitudinal plate 72 extending along the bottom of the viaduct span. In order to attach the longitudinal plates 72, each viaduct section is provided with a mounting angle 74 positioned on each side of the channel 70. The mounting angles 74 are embedded in the concrete viaduct section using shear connectors 76 which are welded to the mounting angles. The longitudinal plate 72 is bolted to the mounting angles 74. To facilitate that connection, the mounting angles 74 are drilled at appropriate locations prior to casting the viaduct section, and threaded nuts are welded over the drill holes on top of the mounting angles.

In those cases where the lower tensioning cables are mounted internally to the viaduct section, as illustrated in FIG. 16, the viaduct section 2 is formed without the longitudinal channel 70. Instead, one or more cable guide ducts 50 are formed therein, as appropriate.

Figure 17:
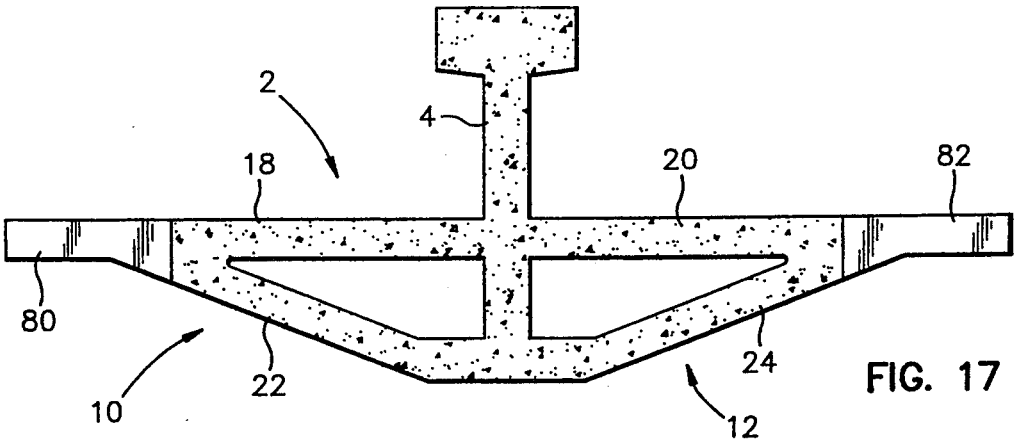
FIG. 17 is a diagrammatic view of a cross-section of the viaduct system of FIG. 5 showing a fabrication method therefor.

Referring now to FIG. 17, it is asserted that longitudinal stresses in the viaduct structure may be controlled by limiting the continuity of the structure to certain areas (i.e., the outboard portions of the platform decks 18 and 20) of the viaduct sections. This is particularly advantageous because it allows more efficient (cost saving) use of the post tensioning cables. The ability to limit section continuity is due in part to the fact that the platform decks 18 and 20 can be located at the approximate middle (i.e., the neutral axis) of the viaduct section, depth-wise, so that they do not contribute to the resistance of the section in response to externally applied loads. This limited continuity can be built into the viaduct structure during slab formation, if the structure is cast in place, or cast in the end faces of the pre-cast segments if the viaduct structure is built using the precast segmental method.

In FIG. 17, areas of discontinuity 80 and 82 are provided in the lateral deck sections 18 and 20, respectively. These areas of discontinuity are gaps which prevent the transfer of compression loads along the longitudinal viaduct span. The gaps are formed using segments of very thin spacer material positioned at the outboard portions of the lateral deck sections 18 and 20. For this purpose, any number of soft or resilient materials may be used. In the event the viaduct structure is cast in place, the spacers would be appropriately positioned in the concrete mold. When a pre-cast segmental method is used, the spacers are appropriately positioned during the match casting process. Conveniently, the spacers may be formed by painting a layer of grease on the previously cast section. That is because the gap required to provide the areas of discontinuity 80 and 82 need not be large, i.e., typically about 0.01 inches.

Figure 18:
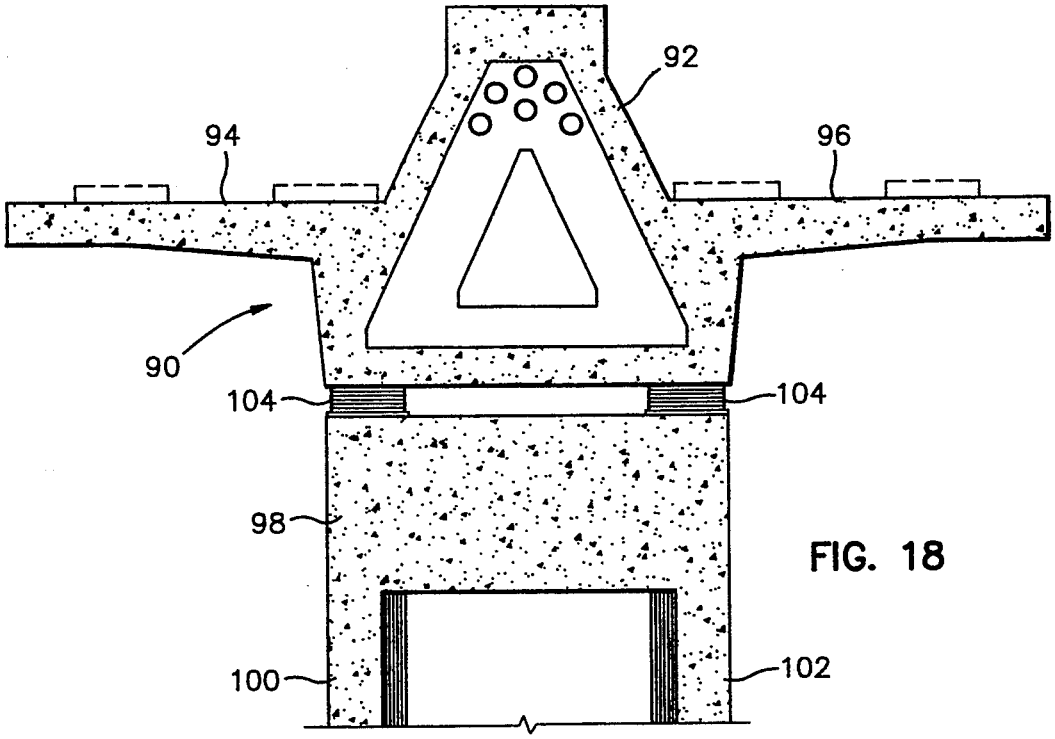
FIG. 18 is a diagrammatic view showing a rapid transit viaduct section constructed in accordance with another aspect of the invention.

Viaduct sections may be formed in accordance with the present invention in a variety of configurations. The central load bearing body, for example, could be formed as an I section, an H section, or a variety of other section shapes. The load bearing body could also be a box section. In the embodiment of FIG. 18, a viaduct section 90 includes a central triangular load bearing body 92 and a pair of lateral platform structures 94 and 96. In this configuration, the central load bearing body forms part of a closed, torsion resistant base section as well as a central load bearing member. The viaduct section 90 is mounted on a pier 98 having upright pier elements 100 and 102. Neoprene pads 104 are provided between the viaduct section 90 and the pier 98.

Figure 19:
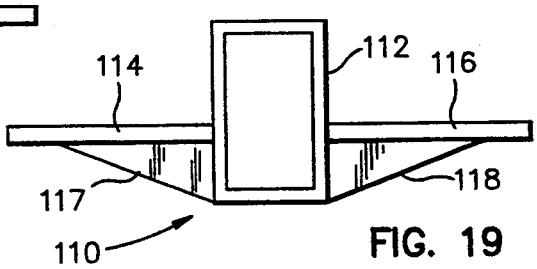
FIG. 19 is a diagrammatic view showing a rapid transit viaduct section constructed in accordance with another aspect of the invention.

In a further embodiment shown in FIG. 19, a viaduct section 110 includes a generally rectangular load bearing body 112 having mounted thereto lateral platform structures 114 and 116. The lateral platform structures are supported by support ribs 117 and 118. In this configuration, the lower "U" shaped portion of the load bearing body 112 forms part of a closed, torsion resistant base section. The upper "U" shaped portion of the load bearing body 112 also forms part of the closed base section and serves additionally as a central load bearing member.

Figure 20:
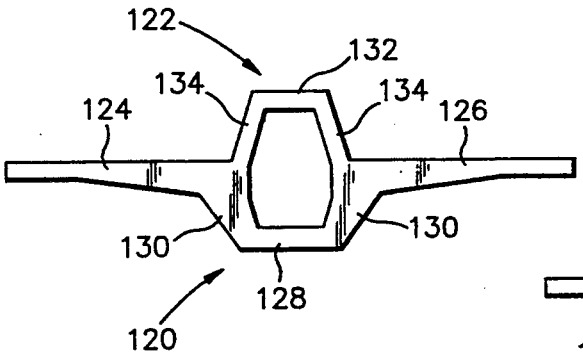
FIG. 20 is a diagrammatic view showing a rapid transit viaduct section constructed in accordance with another aspect of the invention.

In a still further embodiment, shown in FIG. 20, a viaduct section 120 includes a central hexagonal load bearing body 122 having a pair of lateral platform structures 124 and 126 mounted to a lower portion thereof. The load bearing body 112 includes a lower horizontal flange 128 and a pair of lower webs 130 extending upwardly and outwardly therefrom. These components together form part of a closed, torsion resistant base section. The load bearing body 112 further includes an upper horizontal flange 132 and a pair of upper webs 134 extending downwardly and outwardly therefrom to meet the upwardly extending lower webs 130. The components 132 and 134 together form part of the closed base section and serve additionally as a central load bearing member.

Figure 1:
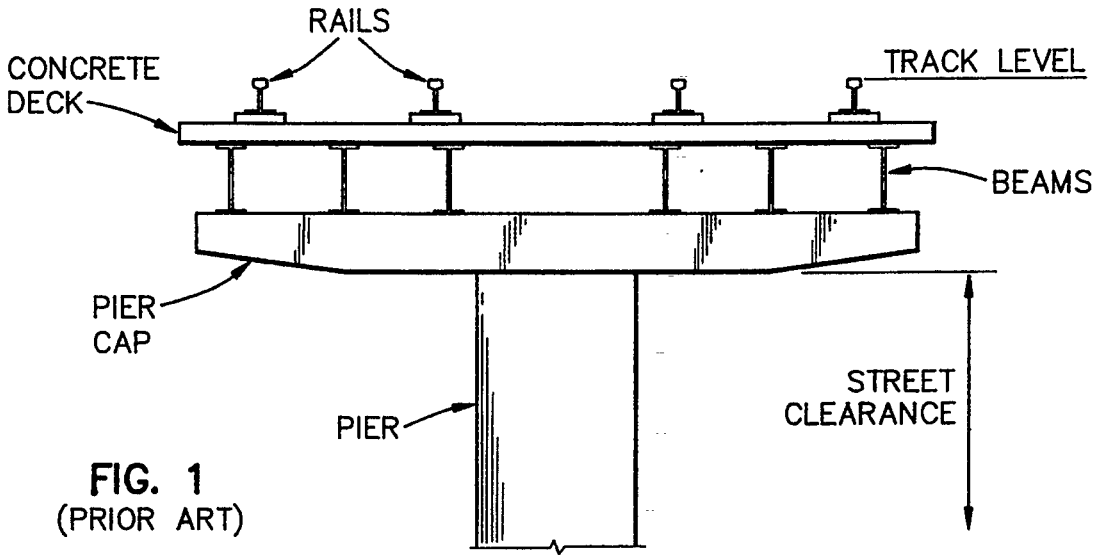
FIG. 1 (PRIOR ART)
FIG. 1 is a diagrammatic view showing a cross-section of a first prior art rapid transit viaduct structure.
Figure 2:
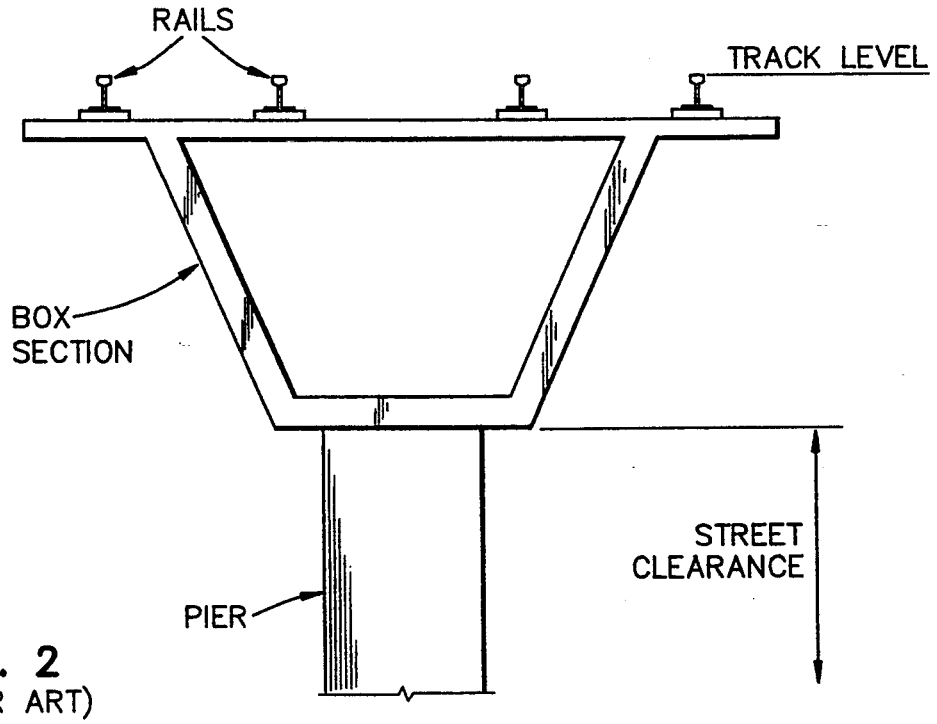
FIG. 2 (PRIOR ART)
FIG. 2 is a diagrammatic view showing a cross-section of a second prior art rapid transit viaduct structure.
Figure 3:
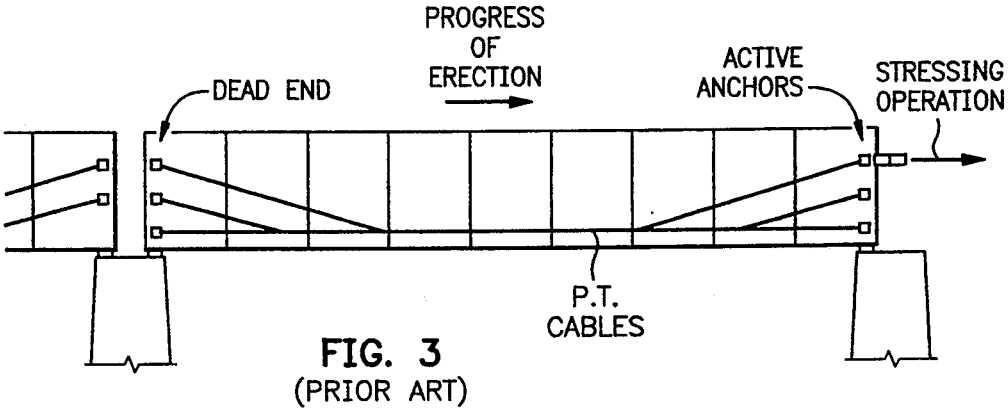
FIG. 3 (PRIOR ART)
FIG. 3 is a diagrammatic side view of a prior art segmental viaduct span with conventional post tensioning.
Figure 21:
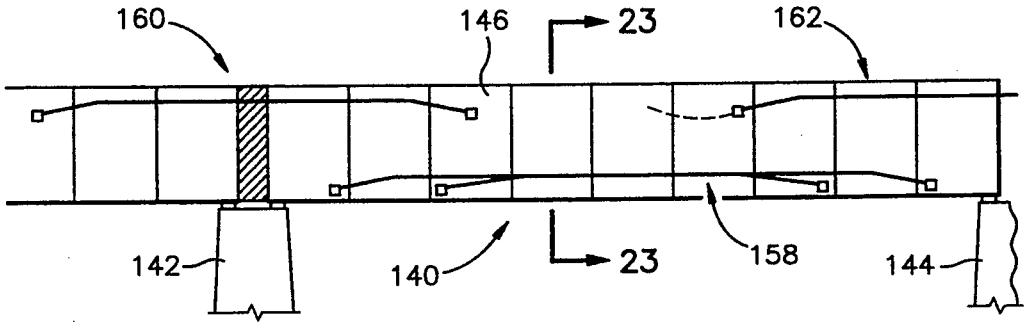
FIG. 21 is a diagrammatic side view showing a segmental viaduct span constructed in accordance with the present invention.
Figure 22:
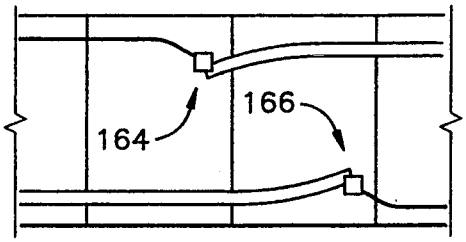
FIG. 22 is a detailed side view showing a portion of the segmental viaduct span of FIG. 21.

Referring now to FIGS. 21 and 22, a viaduct span 140 is formed between a pair of upright viaduct support piers 142 and 144. The viaduct span 140 is made from a plurality of precast concrete segments 146 which may be formed in a variety of shapes including that shown in FIG. 23. The viaduct segment 146 shown in FIG. 23 includes a central load bearing body member 148 having an upper flange 150 and lower channel 152. Attached to the sides of the central body member 148 are a pair of lateral platform structures 154 and 156 which may be used to support the rails of a rapid transit system or traffic lanes for motor vehicles. As shown in FIGS. 21 and 22, the viaduct segments are arranged in longitudinally abutting relationship between the spans 142 and 144. In order to secure the viaduct segments into a continuous load bearing member, a plurality of cable groups illustrated by reference numbers 158,160 and 162 are provided. The cable group 158 is formed by routing a selected number of straight, horizontally extending post tensioning cables through a lower portion of a first central group of adjacent viaduct segments 146. Cable group 158 thus reacts positive bending moments occurring between piers 142 and 144. Cable groups 160 and 162 are formed by routing a selected number of straight, horizontally extending post tensioning cables along an upper portion of second and third groups of adjacent viaduct segments. The second and third viaduct segment groups are positioned on either side of the first viaduct segment group supported by the cables 158. In addition, the second and third viaduct segment groups overlap the first viaduct segment group by at least one segment in order to secure the viaduct span. The second and third viaduct segment groups are preferably centered over each upright pier 142 and 144 and are provided for inter-viaduct connection continuity.

Figure 23:
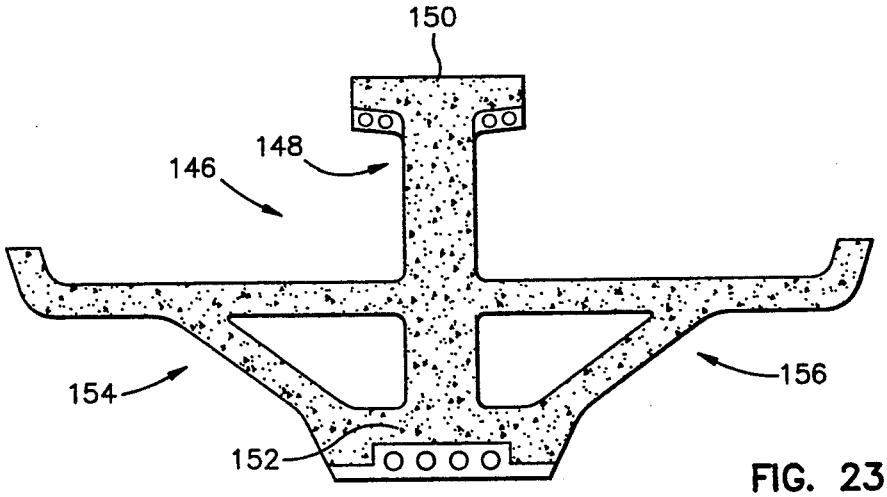
FIG. 23 is a cross-sectional view of the segmental viaduct span of FIG. 21 taken along line 23—23 in FIG. 21.

The routing of the cable groups 158,160 and 162 is illustrated more clearly in FIG. 23. The lower cable group 158 is preferably routed in the lower channel 152 of each viaduct segment 146. The upper cable groups 160 and 162 are routed underneath the flange 150 of each viaduct segment 146. Advantageously, the cable groups are routed through adjacent viaduct segments 146 in order to positively secure the segments together, yet are also positioned outside the viaduct segments so as to be readily accessible for post tensioning. As shown in FIG. 22, the cable groups 158,160 and 162 are secured by conventional anchors, as shown by reference numbers 164 and 166 in FIG. 22.

Figure 24:
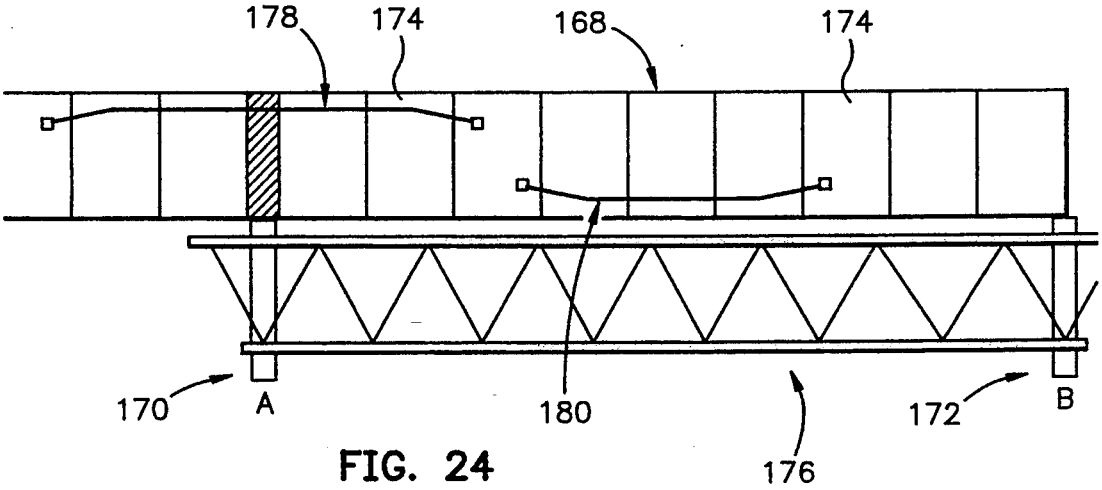
FIG. 24 is a diagrammatic side view showing a method of construction of the viaduct span of FIG. 21.
Figure 25:
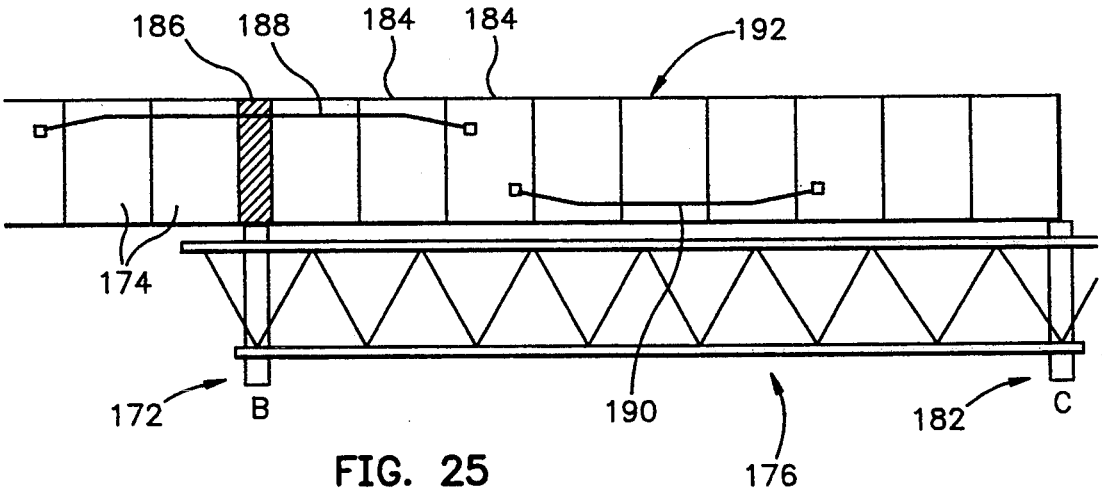
FIG. 25 is a another diagrammatic side view showing the method of construction of FIG. 24.

Referring now to FIGS. 24 and 25, a preferred method for erecting a viaduct span structure between a plurality of upright piers is illustrated. FIG. 24 illustrates a completed viaduct span 168 extending between a pair of upright piers 170 and 172. The viaduct span 168 is made of a plurality of viaduct segments 174 which are mounted on a movable assembly truss 176. The viaduct span 168 is secured by a first group 178 of substantially horizontal continuity cable extending through an upper portion of the viaduct span 168. In addition, the viaduct segments 174 are joined by a second group of substantially horizontal cables 180 extending substantially horizontally through a lower portion of the viaduct span 168.

Referring now to FIG. 25, it is desired to assemble a subsequent viaduct span between upright pier members 172 and 182. To do this, the assembly truss 176 is launched longitudinally until it is supported on each of the piers 172 and 182. Thereafter, placement of a series of viaduct segments 184 commences with a conventional joint 186 first being disposed adjacent the last segment 174 of the viaduct span 168. After one or more segments 184 are positioned, a cable group 188 is routed through adjacent viaduct spans 174 and 184 disposed symmetrically on either side of the spacer 186 and tensioned together for inter-span continuity. As additional segments 174 are positioned, subsequent cabling groups including moment-reacting lower cabling group 190, are added until a complete viaduct span 192 is formed by placing the first few segments of the next subsequent span and routing a subsequent inter-span continuity cable group.

Thus, in accordance with the present invention, instead of placing a rapid transit support structure under the rails, a load bearing structure is placed between the tracks. In a preferred aspect, an inverted "T" structure is utilized to provide the lowest possible platform height. A major advantage of this system is a considerable reduction in the total depth of the structure and a concomitant lowering of the track. By concentrating all loads in the middle of the deck, all along the structure, there is also realized a reduction in the transverse transfer of loads from girders to piers, thus reducing the pier dimensions.

The central load bearing body, being positioned between the rapid transit vehicles, also reduces the risk of vehicle collision in case of a derailment and facilitates guidance of the vehicles to reduce the possibility of derailment. Aesthetically speaking, the viaduct structure looks more slender because of the reduced depth thereof compared to the prior art proposals. This is due to the fact that the track level is positioned intermediately of the central load bearing body and barriers such as the side walls section 16 can be installed to hide the depth of the load bearing body. This is an important consideration for a viaduct in an urban area where the visual impact of a continuous elevated concrete deck must be minimized. The reduced height of the tracks also results in smaller access structures if the tracks need to be brought to the ground level at the ends of the line.

Finally, employing concepts of the present invention, a superior post-tensioning cable layout is provided in order to minimize the time required for cable fabrication and viaduct span construction.

While preferred embodiments of the rapid transit viaduct system have been described, it should be understood that modifications and adaptations thereof will occur to persons skilled in the art. Therefore, the protection afforded the invention should not be limited except in accordance with the spirit of the following claims and their equivalents.

We claim:

1. In a viaduct system made from a plurality of viaduct segments, each viaduct segment including a central load bearing body having opposite side portions, a pair of lateral vehicle support platform structures, one of said platform structures mounted to opposite side portions of said central body, a lower portion located beneath said platform structures, and an upper portion located above said platform structures, said central body extending upwardly from said platform structures to provide a barrier between vehicles disposed on said vehicle support structures, a method for post tensioning said viaduct segments, comprising the steps of:

arranging a plurality of said viaduct segments in a longitudinally abutting adjacent relationship in a first group, a second group, and a third group;

locating said first group between said second group and said third group;

routing a selected number of straight horizontally extending post tensioning cables through the lower portion of the viaduct segments in said first group of adjacent viaduct segments for reacting positive bending moments; and providing a selected number of straight horizontally extending post tensioning cables along the upper portion of the viaduct segments in said second and third groups of adjacent viaduct segments for providing segment continuity.

2. The method of claim 1 wherein said plurality of viaduct segments are supported on at least two upright piers, and wherein said upper post tensioning cables of said second and third viaduct segment groups span said upright piers.

3. The method of claim 1 wherein said upper and lower straight cables are routed through said central body portion of said viaduct segments.

4. The method of claim 3 wherein said upper and lower cables are routed so as to be accessible for post tensioning at locations outside said central body portion of said segments.

5. The method of claim 1 wherein said viaduct segments are supported between a pair of upright piers and wherein said first second and third viaduct segment groups are post tensioned in order to form a continuous viaduct span between said piers prior to forming a continuous viaduct span across subsequent piers.

6. A rapid transit viaduct system with post-tension cabling, comprising:

a plurality of precast concrete viaduct segments arranged in a longitudinally abutting relationship in a first group, a second group, and a third group, each of said viaduct segments including a central load bearing body having opposite side portions and a pair of lateral vehicle support platform structures, one of said platform structures being mounted to each of said opposite side portions of said central body; said central body extending upwardly from said lateral platform structures to provide a barrier between said vehicle support structures;

a plurality of upright piers disposed below and supporting said viaduct segments;

a plurality of lower post-tensioning cable groups extending substantially horizontally through said first group of viaduct segments for reacting positive moments; and a plurality of upper post-tensioning cable groups extending substantially horizontally through said second and third groups of viaduct segments for providing segment continuity, said lower post-tensioning cable groups extending through at least one, but not all of said viaduct segments in said second group, and said lower post-tensioning cable groups extending through at least one, but not all of said viaduct segments in said third group.

7. The viaduct system of claim 6 wherein said upper post tensioning cables of said second and third viaduct segment groups span said upright piers.

8. The viaduct system of claim 6 wherein said upper and lower cable groups are routed through said central body portion of said viaduct segments.

9. The method of claim 8 wherein said upper and lower cables are routed so as to be accessible for post tensioning at locations outside said central body portion of said segments.

10. A method for fabricating a rapid transit viaduct system, comprising the steps of:

fabricating a plurality of precast viaduct segments each having an upper portion and a lower portion, said viaduct segments being configured to be arranged end-to-end and tied together to form a viaduct span for supporting one or more rapid transit vehicles;

fabricating a plurality op upright piers for supporting said viaduct segments;

arranging a first group of said precast viaduct segments end-to-end over a first one of said upright piers;

securing together said first group of precast segments with one or more substantially horizontal first cables extending through the upper portion of the segments in said first precast segment group, for providing segment continuity;

arranging a second group of said precast viaduct segments end-to-end adjacent an end of said first precast segment group;

securing together said second group of precast segments with one or more substantially horizontal second cables extending through the lower portion of the segments in said second precast segment group, for reacting positive moments;

arranging a third group of said precast viaduct segments end-to-end adjacent an end of said second precast segment group and over a second upright pier; and securing together said third group of precast segments with one or more substantially horizontal third cables extending through the upper portions of the segments in said third precast segment group, for providing segment continuity;

wherein said first cables extend through at least one, but not all of the segments in said second precast segment group, and wherein said third cables extend through at least one, but not all of the segments in said second precast segment group.

11. A rapid transit viaduct system, said system comprising:

a plurality of precast viaduct segments each having an upper portion and a lower portion, said viaduct segments being configured to be arranged end-to-end and tied together to form a viaduct span for supporting one or more rapid transit vehicles;

a plurality of upright piers for supporting said viaduct segments;

a first group of said precast viaduct segments arranged end-to-end over a first one of said upright piers, said first group of precast segments being secured together with one or more substantially horizontal first cables extending through the upper portion of the segments in said first precast segment group, for providing segment continuity;

a second group of said precast viaduct segments arranged end-to-end adjacent an end of said first precast segment group, said second group of precast segments being secured together with one or more substantially horizontal second cables extending through the lower portion of the segments in said second precast segment group, for reacting positive moments;

a third group of said precast viaduct segments arranged end-to-end adjacent an end of said second precast segment group and over a second upright pier, said third group of precast segments being secured together with one or more substantially horizontal third cables extending through the upper portions of the segments in said third precast segment group, for providing segment continuity; and wherein said first cables extend through at least one, but not all of the segments in said second precast segment group, and wherein said third cables extend through at least one, but not all of the segments in said second precast segment group.

* * * * *